US006521089B1

(12) United States Patent
Griech et al.

(10) Patent No.: US 6,521,089 B1
(45) Date of Patent: Feb. 18, 2003

(54) PROCESS FOR CONTROLLING OR REGULATING THE BASIS WEIGHT OF A PAPER OR CARDBOARD WEB

(75) Inventors: Wolfgang Griech, Heidenheim (DE); Dirk Thomas, Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/573,270

(22) Filed: May 18, 2000

(30) Foreign Application Priority Data

May 19, 1999 (DE) ..... 199 22 817

(51) Int. Cl.[7] ..... D21F 1/08; D21G 9/00

(52) U.S. Cl. ..... 162/198; 162/198; 162/190; 162/DIG. 11; 700/128

(58) Field of Search ..... 162/198, 190, 162/189, DIG. 6, DIG. 10, DIG. 11, 258–259, 252–253, 263, 264, 202, 208, 216; 700/127–129

(56) References Cited

U.S. PATENT DOCUMENTS 3,619,360 A * 11/1971 Persik, Jr. ..... 162/258
3,981,767 A * 9/1976 Al-Shaikh ..... 162/198
4,098,641 A * 7/1978 Casey et al. ..... 162/198
4,374,703 A * 2/1983 Lebeau et al. ..... 162/253
5,560,807 A * 10/1996 Hauser ..... 162/183
5,674,364 A * 10/1997 Pitkajarvi ..... 162/216
5,746,889 A * 5/1998 Huovila et al. ..... 162/216
5,795,441 A * 8/1998 Lehleiter et al. ..... 162/343
5,814,191 A * 9/1998 Huovila ..... 162/216
5,825,653 A * 10/1998 Huovila et al. ..... 364/471.02
5,843,281 A * 12/1998 Huovila ..... 162/216
5,891,306 A * 4/1999 Chase et al. ..... 162/198
5,900,121 A * 5/1999 Lehleiter et al. ..... 162/322
5,928,475 A * 7/1999 Chase et al. ..... 162/198
5,944,957 A * 8/1999 Fagerlund et al. ..... 162/258
6,162,331 A 12/2000 Ruf et al. ..... 162/198

FOREIGN PATENT DOCUMENTS

EP 0 898 014 A2 * 10/2002

* cited by examiner

*Primary Examiner*—Jose A. Fortuna
(74) *Attorney, Agent, or Firm*—Greenblum & Bernstein, P.L.C.

(57) ABSTRACT

Device and process for controlling or regulating a basis weight of a web in a web manufacturing process of a web producing machine. The device includes a first control circuit, adapted to adjust the basis weight, that includes at least one adjustable device for influencing the basis weight and at least one basis weight sensor. A second control circuit having at least one sensor for detecting a concentration of incoming backwater is also provided. The process includes measuring the basis weight of the material web, adjusting the basis weight of the web with a first control device having at least one device for influencing the basis weight, detecting a retention change in a second control circuit, and counteracting the retention change by influencing a concentration of a stock suspension placed one of onto a wire and between wires.

23 Claims, 4 Drawing Sheets

PROCESS FOR CONTROLLING OR REGULATING THE BASIS WEIGHT OF A PAPER OR CARDBOARD WEB

CROSS-REFERENCE TO RELATED APPLICATIONS

The present application claims priority under 35 U.S.C. §119 of German Patent Application No. 199 22 817.5, filed on May 19, 1999, the disclosure of which is expressly incorporated by reference herein in its entirety.

BACKGROUND OF THE INVENTION

1. Field of the Invention

The invention relates to a device and process for controlling or regulating the basis weight of a paper or cardboard web in a manufacturing process.

2. Discussion of Background Information

An essential quality factor of a paper or cardboard web lies in the uniformity of the basis weight of the web produced. In the manufacturing process of a web of this kind, numerous interference factors occur that can have a negative influence on the uniformity of the basis weight viewed across the machine width and also in the machine direction. These interference factors include, for example, temperature fluctuations, pressure fluctuations, and manufacturing tolerances, but also include errors in the embodiment or adjustment of the paper machine during the manufacturing process. In order to eliminate these negative interference factors to the greatest degree possible and to achieve a uniform manufacture of the paper web, devices and processes are used to control and regulate the basis weight in the lateral and longitudinal direction of the web.

The published, unexamined German Patent Disclosure DE 20 19 975 discloses how, with the aid of two sensors for measuring the basis mass in a traveling web, the actual basis weight cross profile and the actual basis weight longitudinal profile can be extracted from a measured diagonal profile and longitudinal profile and can be used for controlling or regulating the basis weight of a web.

The Patent Document DE 35 35 849 discloses changing the width of the outlet gap of a headbox at particular locations on the web width so that the flow rate of the stock suspension correspondingly changes locally. If the flow rate of the stock suspension changes locally with the same concentration across the machine width, then this influences the quantity of solids at this point in the web with regard to the web width and thus produces a change in the basis weight at this point or at this strip of the web.

The Patent Application DE 40 19 593 A1 discloses a device and a process for regulating the basis weight cross profile of a paper web. According to this document, the concentration of the stock suspension flow at this location is changed using a variation of the basis weight cross profile of the paper web at a particular location on the web width. In order to achieve this, the proposal is made to section the headbox at least partially across the machine width and to supply it with individually adjustable concentrations with the aid of regulated sectional flows. The individual adjustment of the concentration of each sectional flow takes place by a regulation of the inflow conditions of two individual flows with constant, but different, concentrations. As a result of the different solids content of the sectional flows, a change in the basis weight is produced at the corresponding location on the web width.

In the regulating process used here, the basis weight cross profile of the paper web is measured at the end of the paper machine and, through the use of a control circuit, the aperture on the headbox is regulated or the inflow conditions of the individual flows are regulated with different concentrations for the respective sections.

A regulating process of this kind with the measurement of the basis weight cross profile has been disclosed, for example, by the Patent Applications DE 40 05 281 or DE 42 38 037. In both of the above-mentioned documents, the basis weight cross profile of the paper web is measured at the end of the paper machine and, by a process guidance system, the necessary adjustment of the actuators is produced in order to sectionally influence the basis weight.

The disclosures of the above-cited prior art are expressly incorporated by reference herein in their entireties, with particular emphasis on the regulation techniques and regulation mechanisms disclosed.

The problem with this prior art is that the known regulation of the basis weight has a relatively sluggish behavior with long reaction times.

SUMMARY OF THE INVENTION

The object of the invention is to develop the known paper machine with a regulation of the basis weight and the corresponding process so that the reaction times of the regulation are significantly shortened and influence can therefore also be exerted on fluctuations in the paper manufacturing process which in their chronological course, have a shorter wavelength than the travel time of the paper web through the paper machine.

The object of the invention is attained by an additional control circuit having at least one sensor for detecting the concentration of the incoming backwater. According to the process, another control circuit can be provided such that, after the detection of a retention change, the retention change is counteracted by influencing the concentration of the stock suspension that is placed onto the wire or introduced between the wires.

Consequently, we propose improving the known device for controlling or regulating the basis weight of a paper or cardboard web in the manufacturing process of a paper or cardboard machine, having a first control circuit for adjusting the basis weight with at least one adjustable device for influencing the basis weight and at least one basis weight sensor so that another control circuit with at least one sensor for determining the concentration of the incoming backwater is provided.

Advantageously, the at least one device for influencing the basis weight can be embodied as a multitude of adjustable element which are arranged distributed across the width of the machine. For example, this corresponds to a paper machine with a dilution water-regulated headbox, which has mixers or valves distributed across the width of the machine, which sectionally regulate the stock suspension concentration by different mixture ratios of backwater and high-consistency pulp.

It can also be advantageous for the at least one adjustable device for influencing the basis weight to be provided as an actuator for the second control circuit.

In another embodiment of the invention, the at least one sensor for the concentration of the backwater can be arranged before or in a backwater container or also in a line for supplying backwater to the headbox. In this connection, however, the control path can be shorter the closer to the extraction of the backwater, i.e., to the wet section, the measurement is carried out. However, by a measurement after an intermediary buffer, for example, a backwater container, small fluctuations can be eliminated which could lead to erroneous regulating actions.

It is also advantageous for the additional control circuit to be connected to the actuators of the first control circuit. This embodiment can save on the number of actuators.

On the one hand, the sensor for measuring the basis weight and, optionally, the moisture, can be positioned at the end of the drying section or between the press section and the drying section, preferably at the end of the press section. If the sensor is positioned at the end of the press section, then the control path is shortened by approximately 90% in comparison to a measurement at the end of the drying section. Furthermore, errors and interruptions are detected in a significantly more rapid fashion and consequently can be eliminated or influenced in a significantly more rapid fashion, by which unproductive operating times can be significantly curtailed.

With regard to the process, the inventor proposes improving the known process for controlling or regulating the basis weight of a paper or cardboard web in the manufacturing process with a first control circuit which adjusts the basis weight of the web with the aid of at least one basis weight measurement and at least one device for influencing the basis weight so that, in another control circuit, after the detection of a retention change, the retention change is counteracted by influencing the concentration of the stock suspension that is placed onto the wire or introduced between the wires.

As an advantageous possibility for detecting the retention, we propose performing the measurement in the incoming backwater. For this purpose, it is suitable to determine the retention by a measurement of the concentration of the solids contents. For example, this can be carried out by determining the retention directly by comparing the solids quantity applied through the headbox and the solids quantity removed again by the wet section. Another possibility is determining the change in the concentration of the solids percentages in the backwater and drawing conclusions about the retention based on this.

A point before the backwater container or also in the backwater supply can be selected as an advantageous measurement location for detecting a retention change.

According to a particular embodiment of the process, the proposal is made to subordinate the additional control circuit to the first control circuit. Furthermore, the additional control circuit can also use the actuators of the first control circuit.

According to the invention, in a detection of a retention reduction, the proposal is furthermore made to increase the concentration of the stock suspension supplied to the headbox and/or, in a detection of a retention increase, the proposal is made to reduce the concentration of the stock suspension supplied to the headbox.

Another advantageous possibility for influencing the basis weight includes supplying a possibly concentrated retention agent in a detection of a retention decrease or by decreasing the supply of retention agent in a detection of a retention increase.

Naturally, the above described process can also be used to regulate a backwater-regulated headbox that is sectioned across the width of the machine. Particularly in this connection, reference is also made to the Applicant's as yet unpublished Patent Applications DE 197 36 047 and DE 197 36 048.

DE 197 36 047 discloses and describes a paper machine with a first and second control circuit for basis weight regulation where, as a measurement variable, the second control circuit uses the basis mass of the web being produced, before the drying section, in order to compensate for fluctuations in the basis weight of the web in the machine direction before the web passes through the entire paper machine to the winding.

DE 197 36 048 discloses and describes how, in a sectioned headbox that is regulated with dilution water, a self-induced blockage of the regulation of the mass cross profile can be prevented with the aid of a second control circuit.

Additionally, the disclosures of these German Patent Applications are expressly incorporated by reference herein in their entireties, with particular emphasis on the regulation techniques and regulation mechanisms disclosed therein.

Other embodiments of the invention are represented in the dependent claims and in the following description of the figures.

Naturally, the features of the invention described above and explained below can be used not only in the combinations indicated, but can also be used in other combinations or individually without departing from the scope of the invention.

The above-described rapid regulation according to the invention, which is based on the existing basis weight regulation and which reacts in the narrow loop, with regard to interference variables such as a changing consistency of the stock suspension, advantageously achieves an improvement of the profiles taking place with any change in the retention. This results in a reduction in the amount of waste when there is a screening change and a reduction in the screening change time. This also permits the prevention of tears in the paper web due to profile interferences. Formation interferences due to profile interferences are also reduced.

The present invention is directed to a device for controlling or regulating a basis weight of a web in a web manufacturing process of a web producing machine. The device includes a first control circuit, adapted to adjust the basis weight, that includes at least one adjustable device for influencing the basis weight and at least one basis weight sensor. A second control circuit having at least one sensor for detecting a concentration of incoming backwater is also provided.

In accordance with a feature of the invention, the at least one device for influencing the basis weight can include a plurality of adjustable elements which are arranged across a width of the machine.

According to a feature of the present invention, the at least one adjustable device for influencing the basis weight can be an actuator for the second control circuit.

According to another feature of the instant invention, the at least one sensor for detecting the concentration of the backwater may be positioned one of before and in a backwater container.

Further, the at least one sensor for detecting the concentration of the backwater may be positioned in a backwater supply to a headbox.

The device can also include at least one actuator coupled to the at least one adjustable device. The second control circuit may be coupled to the at least one actuator.

According to still another feature of the invention, the at least one basis weight sensor may be located in a vicinity of a drying section. The at least one basis weight sensor can be located at an end of the drying section.

The at least one basis weight sensor can be located between a press section and a drying section. Further, the at least one basis weight sensor may be located directly after the press section.

According to another feature of the invention, the material web can be one of a paper and cardboard web, and the machine can be one of a paper and cardboard machine.

The instant invention is directed to a process for controlling or regulating a basis weight of a material web in a manufacturing process. The process includes measuring the basis weight of the material web, adjusting the basis weight of the web with a first control device having at least one device for influencing the basis weight, detecting a retention change in a second control circuit, and counteracting the retention change by influencing a concentration of a stock suspension placed one of onto a wire and between wires.

According to a feature of the present invention, the detection of the retention change can be made by measuring the incoming backwater.

In accordance with another feature of the instant invention, the detection of the retention change can be made by measuring a concentration of incoming backwater.

Further, the detection of the retention change can be made in incoming backwater before a backwater container.

Still further, the detection of the retention change can be made in backwater of a headbox supply.

According to a further feature of the instant invention, the second control circuit can be subordinate to the first control circuit.

In accordance with a still further feature of the present invention, the first control circuit can include actuators coupled to the at least one device for influencing the basis weight, and the second control circuit can be coupled to the actuators.

According to another feature of the invention, when a reduction in retention is detected, the process can further include increasing a concentration of a stock suspension supplied to a headbox. Also, when an increase in retention is detected, the process can further include reducing a concentration of a stock suspension supplied to a headbox.

In accordance with still another feature of the invention, when a decrease in retention is detected, the process can further include supplying a retention agent. Moreover, the retention agent can be a concentrated retention agent. Further, when an increase in retention is detected, the process can further include reducing a supply of retention agent.

According to another feature of the invention, the process can further include regulating a backwater-regulated headbox that is sectioned across a width of the machine.

Further, the at least one basis weight measurement can be made in a vicinity of a drying section. The at least one basis weight measurement can be made at an end of the drying section.

Still further, the at least one basis weight measurement may be made in a vicinity between a press section and a drying section. The at least one basis weight measurement may be made at an end of the press section.

The present invention is directed to an apparatus for controlling or regulating a basis weight of a web in a web manufacturing process of a web producing machine. The apparatus includes a first control circuit, at least one adjustment element coupled to the first control circuit adapted to adjust the basis weight of the web, and at least one basis weight sensor coupled to the first control circuit adapted to measure the basis weight. The first control unit controls the at least one adjustment device in accordance with a measured basis weight. The apparatus also includes a second control circuit, and at least one sensor adapted for detecting a concentration of incoming backwater. The second control circuit is adapted to adjust the basis weight in accordance with the detected concentration.

According to a feature of the invention, the apparatus can further include a headbox having a stock inlet and a backwater supply coupled to the stock inlet. The at least one adjustment element can be coupled to the backwater supply, and the second control circuit can be coupled to the at least one adjustment device. The at least one adjustment element can include a backwater adjustment element and a stock adjustment element. The first control circuit and the second control circuit may each be coupled to the backwater adjustment element and the stock adjustment element.

In accordance with another feature of the invention, the apparatus can further comprising a headbox having a stock inlet with a stock inlet control and a backwater supply coupled to the stock inlet with a backwater supply control. The at least one adjustment element may be coupled to the stock inlet and, the second control circuit may be coupled to the backwater supply control and to the stock inlet control.

According to still another feature of the invention, the apparatus can further include a headbox having a stock inlet having a first stock inlet adjustment element and a second stock inlet adjustment element and a backwater supply coupled to the stock inlet. The at least one adjustment element may be coupled to the backwater supply, and the first control circuit can be further coupled to the second stock inlet adjustment element, and the second control circuit may be coupled to the at least one adjustment device and to the first stock inlet adjustment element.

The present invention is directed to a process for controlling or regulating a basis weight of a web in a web manufacturing process of a web producing machine. The process includes measuring a basis weight of the web, controlling at least one adjustment device with a first control circuit in accordance with the measured basis weight to adjust the basis weight of the web, detecting a concentration of incoming backwater, and adjusting the basis weight with a second control circuit in accordance with the detected concentration.

According to a feature of the present invention, the machine can include a headbox having a stock inlet and a backwater supply coupled to the stock inlet, and the process may further include adjusting the backwater supply via the at least one adjustment element is coupled to the backwater supply. The second control circuit may also be coupled to the at least one adjustment device. The at least one adjustment element can include a backwater adjustment element and a stock adjustment element, and the process can further include adjusting the backwater adjustment element via at least one of the first and second control circuits, and adjusting the stock adjustment element via at least one of the first and second control circuits.

In accordance with another feature of the instant invention, the machine can include a headbox having a stock inlet with a stock inlet control, and a backwater supply coupled to the stock inlet with a backwater supply control, and the process can further include adjusting the stock inlet via the at least one adjustment element and adjusting the backwater supply control and the stock inlet control via the second control circuit.

According to yet another feature of the instant invention, the machine can include a headbox having a stock inlet having a first stock inlet adjustment element and a second stock inlet adjustment element, and a backwater supply coupled to the stock inlet, and the process can further include adjusting the backwater supply with the at least one adjustment element, adjusting the second stock inlet adjustment element with the first control circuit, and adjusting the first stock inlet adjustment element and the at least one adjustment device with the second control circuit.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
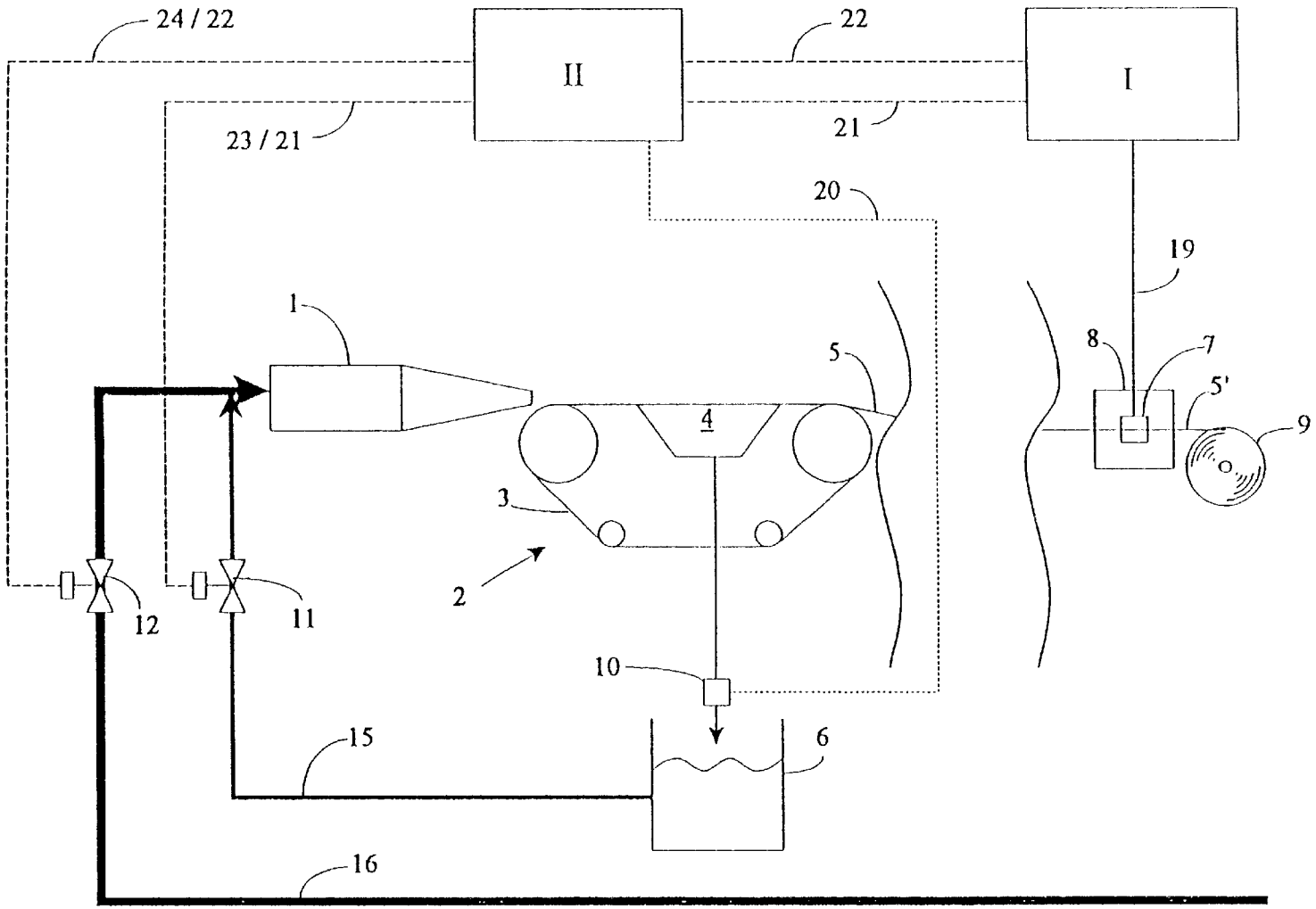
FIG. 1 is a schematic representation of a paper machine with two overlapping control circuits I and II.

FIG. 1 shows a schematic representation of a paper machine with two overlapping control circuits I and II. In the paper machine, the headbox 1 is shown, which supplies stock suspension to the wire section 2, which is comprised of a revolving wire 3 and a drainage unit 4. The fibrous web 5 being produced is conveyed by press sections and drying sections that are not shown and is then wound onto a roll 9 as a finished paper web 5'.

A measurement frame 8, in which a basis weight sensor 7 is disposed, is provided before the winding, and this sensor detects the basis weight of the finished paper web 5' and supplies it to the control circuit I by way of the measurement line 19. The control circuit I controls a first actuator 11 and a second actuator 12 by a first control line 21 and a second control line 22.

The first actuator 11 is disposed in the first supply line 15 to the headbox 1 and influences the backwater quantity of the wire circuit that is supplied to the headbox 1. The second actuator 12 influences the quantity of more highly concentrated stock suspension that is supplied to the headbox 1.

By adjusting the two actuators 11 and 12 via control circuit I based on the basis weight measured by the basis weight sensor 7, influence can be exerted on the concentration of the total stock suspension supplied to the headbox 1 and, in this way, the basis weight of the finished paper web 5' can be kept constant in the desired manner.

In newer paper machines, the actuators 11 and 12 can include a multitude of actuators distributed across the width of the machine which, in this manner, regulate not only the overall basis weight of the paper web produced but also the basis weight cross profile of the paper web. Under these circumstances, a basis weight sensor is usually used which travels across the entire width of the paper web being produced and, in this manner, measures a basis weight cross profile of the paper web being produced and correspondingly influences the individual actuators.

Since the control path for this shown and intrinsically known control circuit I is very long, according to the invention, this control circuit I has a second control circuit II subordinate to it, which has a significantly shorter reaction time.

The reduced reaction time is produced in that the subordinate control circuit II has a sensor 10 for measuring the concentration of the incoming backwater in the wire section. In the current example, this sensor is disposed before the inlet of the backwater into the backwater container 6. A measurement line 20 leads from the concentration sensor 10 to the second control circuit II, which engages in the event of a suddenly occurring concentration change in the backwater. The control circuit II likewise acts on the two actuators 11 and 12 with its control lines 23 and 24 which, in this instance, are identical to the control lines 22 and 21 of the control circuit I.

Figure 2:
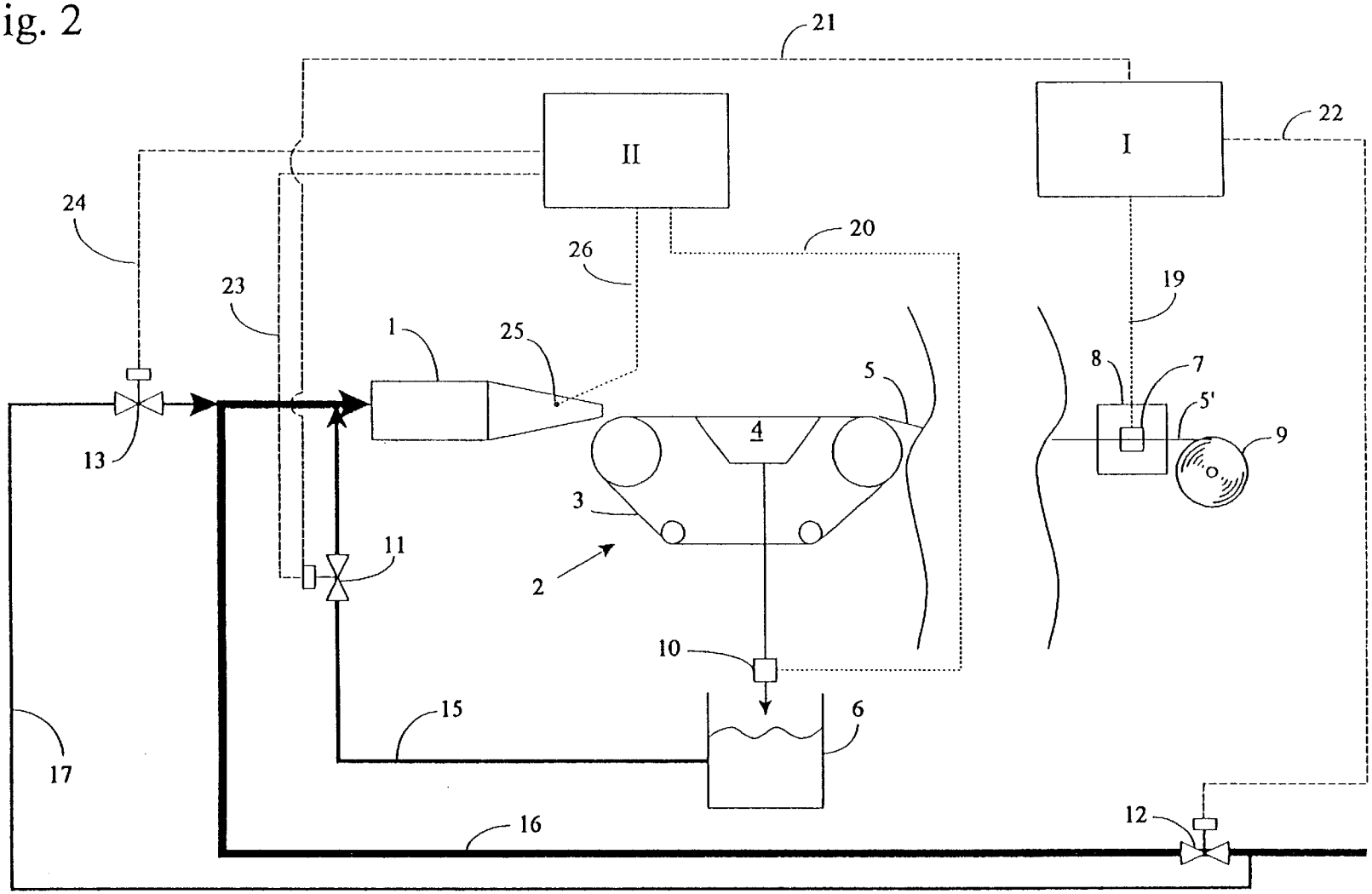
FIG. 2 is a schematically represented paper machine with a first control circuit I and a second, subordinate control circuit II.

FIG. 2 shows a schematic representation of a paper machine according to FIG. 1, with a first control circuit I and a second, subordinate control circuit II.

The first control circuit I corresponds to the known situation of the control circuit I from FIG. 1, which regulates the basis weight of the paper web being produced by adjusting actuators 11 and 12 in the supply lines to the headbox.

The subordinate control circuit II has two concentration sensors. The first concentration sensor 10 measures the concentration of the backwater, while the second concentration sensor 25 measures the concentration of the stock suspension supplied by headbox 1. The retention can be easily determined from the ratio of the two concentration values (stock suspension concentration/backwater concentration) so that, in the event of a sudden retention reduction, countermeasures can be taken by actuator 13, which influences the quantity of the highly concentrated stock suspension that is supplied to the headbox 1, and by actuator 11, which influences the quantity of the backwater supply.

Figure 3:
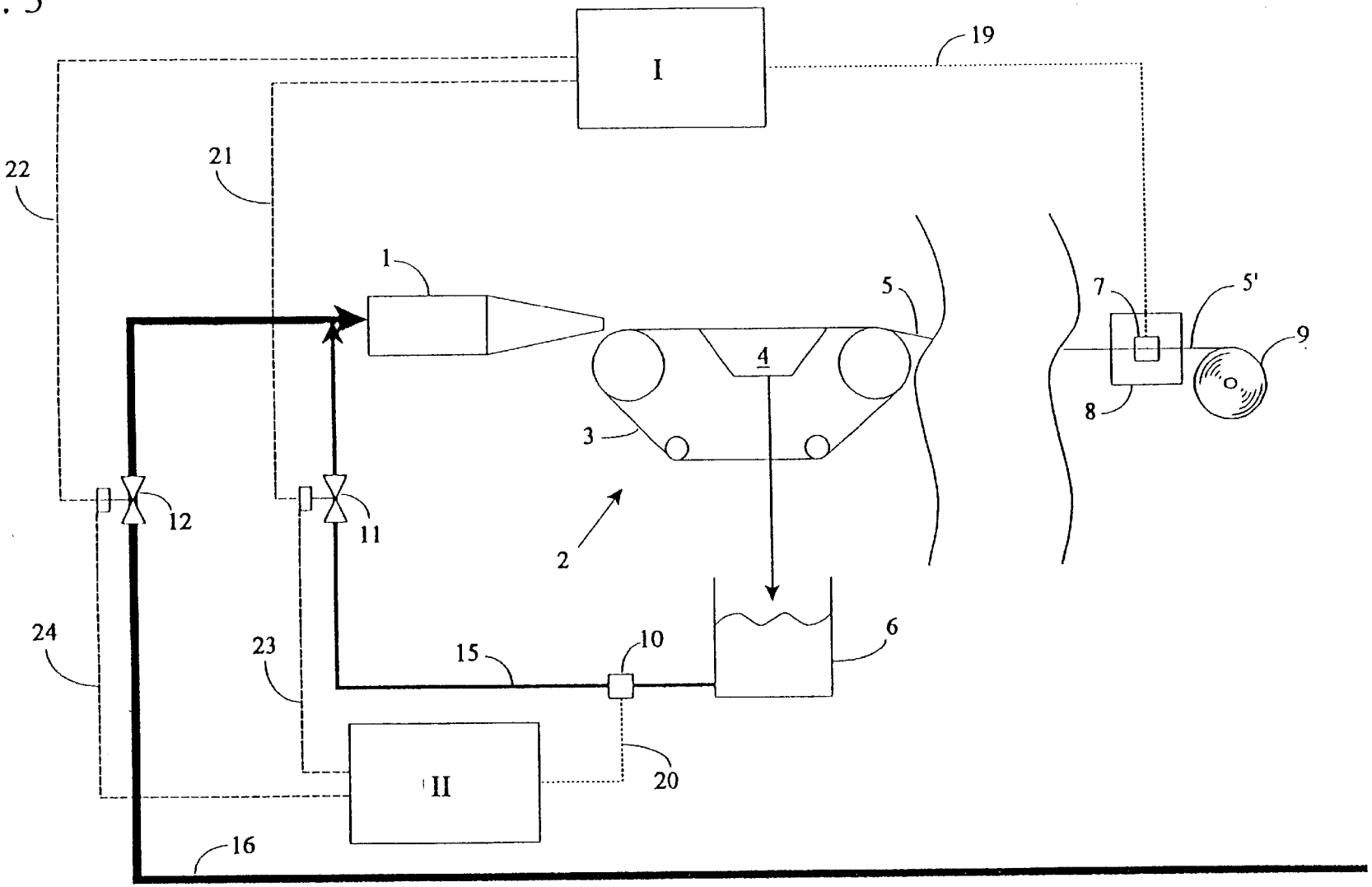
FIG. 3 shows an embodiment of the control circuits I and II, with regulation by mutually controlled valves.

Another possible embodiment of the control circuits is shown in FIG. 3. The paper machine corresponds in its design to FIGS. 1 and 2. A control circuit I is provided, which influences the concentration of the stock suspension supplied to the headbox 1 based on the basis weight measurement of the finished paper web at the end of the paper machine in that the control lines 21 and 22 are used to regulate the actuators 11 and 12 in the first and second supply lines 15 and 16 to the headbox.

In addition, the control circuit II is provided, which is subordinate according to the invention and measures the concentration of the backwater by a concentration sensor 10 after the outlet from the backwater container 6 and, based on the concentration measured, can likewise influence the actuators 11 and 12.

Figure 4:
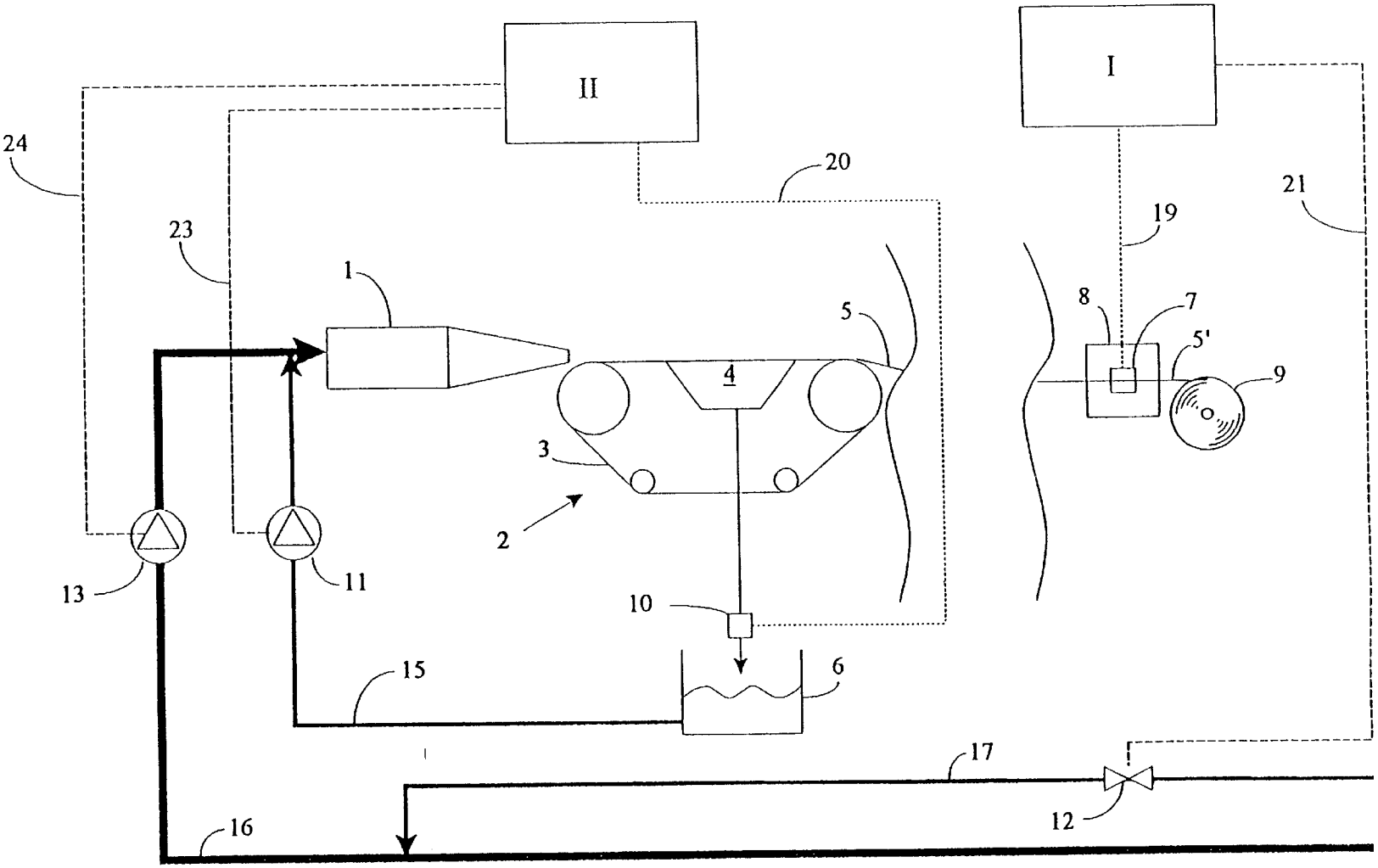
FIG. 4 shows an embodiment of the control circuits I and II, with a two-stage stock density regulation.

Another possibility for the embodiment of the two control circuits I and II in a paper machine is shown in FIG. 4. FIG. 4 shows the paper machine from FIGS. 1 to 3, in which backwater, via a first supply line 15, and highly concentrated stock suspension, via a second supply line 16, are supplied to the headbox in a regulated mixture ratio. The highly concentrated stock suspension, which is supplied to the headbox via the second supply line 16, has an additional supply of high consistency pulp, which is regulated by way of the control circuit I. Consequently, the control circuit I regulates the concentration of the stock suspension supplied to the headbox via the second supply line 16.

A first and second actuator 11 and 13 are disposed in the first and second supply line 15 and 16. Both of the actuators, which are embodied in this instance as speed-regulated feed pumps, are controlled by the second, subordinate control circuit II by control lines 21 and 22. As in FIGS. 1 and 2, the control circuit II has a concentration sensor 10, which measures the concentration of the backwater before it reaches the backwater container 6. Depending on the concentration changes measured in the backwater, a conclusion can be drawn that there is a retention deviation and the control circuit II can be used to exert influence in a short "loop" on the stock suspension concentration supplied to the headbox.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

| | |
|---|---|
| I | first control circuit |
| II | second control circuit |
| 1 | headbox |
| 2 | wire section |
| 3 | wire |
| 4 | drainage unit |
| 5 | fibrous material web |
| 5' | paper web |
| 6 | backwater container |
| 7 | basis weight sensor |
| 8 | measurement frame |
| 9 | paper roll |
| 10 | concentration sensor |
| 11 | first actuator |
| 12 | second actuator |
| 13 | third actuator |
| 15 | first supply line |
| 16 | second supply line |
| 17 | third supply line |
| 19 | first measurement line |
| 20 | second measurement line |
| 21 | first control line |
| 22 | second control line |
| 23 | third control line |

-continued

LIST OF REFERENCE CHARACTERS

| | |
|---|---|
| 25 | second concentration sensor |
| 26 | third measurement line |

What is claimed:

1. A process for controlling or regulating a basis weight of a material web in a manufacturing process, comprising:

measuring the basis weight of the material web;

adjusting the basis weight of the web with a first control device having at least one device for influencing the basis weight;

detecting a retention change in a second control circuit;

counteracting the retention change by influencing a concentration of a stock suspension placed one of onto a wire and between wires.

2. The process according to claim 1, wherein the detection of the retention change is made by measuring the incoming backwater.

3. The process according to claim 1, wherein the detection of the retention change is made by measuring a concentration of incoming backwater.

4. The process according to claim 1, wherein the detection of the retention change is made in incoming backwater before a backwater container.

5. The process according to claim 1, wherein the detection of the retention change is made in backwater of a headbox supply.

6. The process according to claim 1, wherein the second control circuit is subordinate to the first control circuit.

7. The process according to claim 1, wherein the first control circuit includes actuators coupled to the at least one device for influencing the basis weight, and the second control circuit is coupled to the actuators.

8. The process according to claim 1, wherein when a reduction in retention is detected, the process further includes increasing a concentration of a stock suspension supplied to a headbox.

9. The process according to claim 1, wherein when an increase in retention is detected, the process further includes reducing a concentration of a stock suspension supplied to a headbox.

10. The process according to claim 1, wherein when a decrease in retention is detected, the process further includes supplying a retention agent.

11. The process according to claim 10, wherein the retention agent is a concentrated retention agent.

12. The process according to claim 1, wherein when an increase in retention is detected, the process further comprises reducing a supply of retention agent.

13. The process according to claim 1, further comprising regulating a backwater-regulated headbox that is sectioned across a width of the machine.

14. The process according to claim 1, wherein the at least one basis weight measurement is made in a vicinity of a drying section.

15. The process according to claim 14, wherein the at least one basis weight measurement is made at an end of the drying section.

16. The process according to claim 1, wherein the at least one basis weight measurement is made in a vicinity between a press section and a drying section.

17. The process according to claim 16, wherein the at least one basis weight measurement is made at an end of the press section.

18. The process according to claim 1, wherein the material web comprises one of a paper and cardboard web.

19. A process for controlling or regulating a basis weight of a web in a web manufacturing process of a web producing machine, comprising:

measuring a basis weight of the web;

controlling at least one adjustment device with a first control circuit in accordance with the measured basis weight to adjust the basis weight of the web;

detecting a concentration of incoming backwater; and adjusting the basis weight with a second control circuit in accordance with the detected concentration.

20. The process according to claim 19, wherein the machine includes a headbox having a stock inlet and a backwater supply coupled to the stock inlet, and the process further comprises:

adjusting the backwater supply via the at least one adjustment element is coupled to said backwater supply, wherein said second control circuit is also coupled to the at least one adjustment device.

21. The process according to claim 20, wherein the at least one adjustment element includes a backwater adjustment element and a stock adjustment element, and the process further comprises:

adjusting the backwater adjustment element via at least one of the first and second control circuits; and adjusting the stock adjustment element via at least one of the first and second control circuits.

22. The process according to claim 19, wherein the machine includes a headbox having a stock inlet with a stock inlet control, and a backwater supply coupled to said stock inlet with a backwater supply control, the process further comprises:

adjusting the stock inlet via the at least one adjustment element; and adjusting the backwater supply control and the stock inlet control via the second control circuit.

23. The process according to claim 19, wherein the machine includes a headbox having a stock inlet having a first stock inlet adjustment element and a second stock inlet adjustment element, and a backwater supply coupled to said stock inlet, the process further comprises:

adjusting the backwater supply with the at least one adjustment element;

adjusting the second stock inlet adjustment element with the first control circuit; and adjusting the first stock inlet adjustment element and the at least one adjustment device with the second control circuit.

* * * * *